US007151492B2

(12) United States Patent
Iguchi et al.

(10) Patent No.: US 7,151,492 B2
(45) Date of Patent: Dec. 19, 2006

(54) ANTENNA AND PORTABLE WIRELESS DEVICE

(75) Inventors: Akihiko Iguchi, Moriguchi (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 1 day.

(21) Appl. No.: 10/527,838

(22) PCT Filed: Sep. 28, 2004

(86) PCT No.: PCT/JP2004/014574

§ 371 (c)(1),
(2), (4) Date: Mar. 15, 2005

(87) PCT Pub. No.: WO2005/031920

PCT Pub. Date: Apr. 7, 2005

(65) Prior Publication Data

US 2005/0270237 A1 Dec. 8, 2005

(30) Foreign Application Priority Data

Sep. 29, 2003 (JP) ..... 2003-337214

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS

| | | | | |
|---|---|---|---|---|
| 4,320,401 | A | 3/1982 | Schiavone | 343/700 |
| 6,255,994 | B1 * | 7/2001 | Saito | 343/700 MS |
| 6,693,594 | B1 * | 2/2004 | Pankinaho et al. | 343/700 MS |
| 6,882,317 | B1 * | 4/2005 | Koskiniemi et al. | 343/700 MS |
| 6,903,688 | B1 * | 6/2005 | Edvardsson | 343/700 MS |
| 6,950,072 | B1 * | 9/2005 | Miyata et al. | 343/702 |
| 2003/0098813 | A1 | 5/2003 | Koskiniemi et al. | 343/702 |
| 2005/0225484 | A1 * | 10/2005 | Kuramoto | 343/700 MS |

FOREIGN PATENT DOCUMENTS

| | | |
|---|---|---|
| JP | 4-157908 | 5/1992 |
| JP | 7-20711 | 4/1995 |
| JP | 10028013 | 1/1998 |
| JP | 10-107535 | 4/1998 |
| JP | 2002-319811 | 10/2002 |
| JP | 2002-335117 | 11/2002 |
| JP | 3430809 | 5/2003 |

* cited by examiner

*Primary Examiner*—Tan Ho
(74) *Attorney, Agent, or Firm*—Steptoe & Johnson LLP

(57) ABSTRACT

A planar inverted-F antenna has a ground plate provided on a circuit board, a planar radiator, a short line, a feed line, and an inductance element. The radiator is disposed facing the ground plate. The short line and the feed line are connected to the radiator. The inductance element is connected electrically between the ground plate and the short line.

7 Claims, 5 Drawing Sheets

ANTENNA AND PORTABLE WIRELESS DEVICE

This application is a U.S. national phase application of PCT international application PCT/JP2004/014574.

TECHNICAL FIELD

The present invention relates to a planar inverted-F antenna and a mobile communication device using the same such as a portable telephone or a personal handyphone.

BACKGROUND ART

Terminals for mobile communication devices such as portable telephones or the like are progressing in downsizing. Most mobile communication devices are equipped with a built-in antenna inside housing recently. FIG. 7A shows a perspective view of a conventional mobile communication device, and FIG. 7B shows a perspective side view of the same.

Circuit board 101 is disposed in housing 100. Display 109, input unit 111, circuit 110 and planar inverted-F antenna (hereafter referred to "antenna") 108 are disposed in housing 100, and are connected to circuit board 101 respectively.

FIG. 8 shows an exploded perspective view of conventional antenna 108. Ground plate 102 is provided on circuit board 101. Radiator 103 is disposed facing circuit board 101. Short line 104 connects radiator 103 with ground plate 102. Feed line 105 is connected to radiator 103. Feed terminal 106 connects feed line 105 with a circuit (not shown). Slit 107 is formed in radiator 103.

By adjusting a gap distance between short line 104 and feed line 105, the impedance of antenna 108 is varied to implement an impedance matching. A length of slit 107 is varied to adjust the gap distance between short line 104 and feed line 105. Japanese Patent Application Unexamined Publication No. H4-157908 discloses an example of such antenna.

To implement the impedance matching by adjusting the length of slit 107, however, slit 107 must be extended causing radiator 103 to have a larger area. This would result in a larger shape of antenna 108, and eventually cause a difficulty in the device downsizing. Moreover, extending slit 107 requires changing the geometry of antenna 108 itself that needs redesigning of molds to produce antenna 108, thus it is not an easy task.

SUMMARY OF THE INVENTION

A planar inverted-F antenna of the present invention has a ground plate provided on a circuit board, a planar radiator, a short line, a feed line, and an inductance element. The radiator is disposed facing the ground plate. The short line and the feed line are connected to the radiator. The inductance element connects the ground plate with the short line electrically. By connecting the inductance element to adjust the antenna impedance, a downsized antenna capable of adjusting the impedance without changing the antenna form can be achieved. The mobile communication device disclosed of the present invention has a housing, a circuit board, an aforementioned antenna provided in the housing, the antenna connected to the circuit board, a circuit, an output unit and an input unit, the circuit, the output unit and the input unit connected to the circuit board respectively.

DETAILED DESCRIPTION OF THE EXEMPLARY EMBODIMENT

Figure 1A:
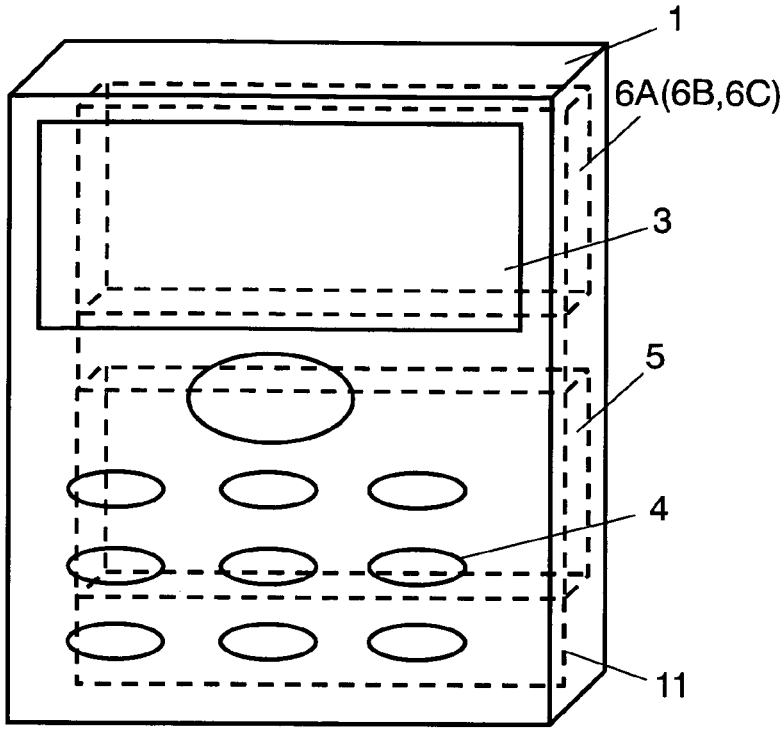
FIG. 1A shows a perspective view of a mobile communication device according to an exemplary embodiment of the present invention.
Figure 1B:
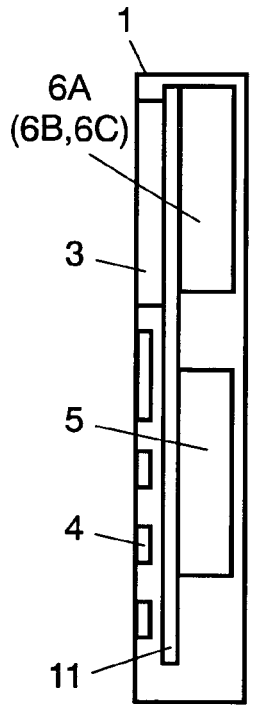
FIG. 1B shows a perspective side view of the mobile communication device shown in FIG. 1A.

FIG. 1A shows a perspective view of the mobile communication device according to the exemplary embodiment of the present invention, and FIG. 1B a perspective side view. Circuit board 11 is disposed in housing 1. Output unit 3, input unit 4, circuit 5 and planar inverted-F antenna (antenna) 6A are connected to circuit board 11 respectively in housing 1. Circuit 5 has a capability of at least sending/receiving communication from external through antenna 6A, showing external information or input data from input unit 4 on output unit 3. That is, output unit 3 shows information input into circuit 5. Input unit 4 receives information input and sends it to circuit 5. A rotary encoder or a mike can replace input unit 4 shown as a ten-key in FIG. 1A. Similarly, a speaker can replace output unit 3 that is shown as a displaying device such as LCD panel or the like.

Figure 2:
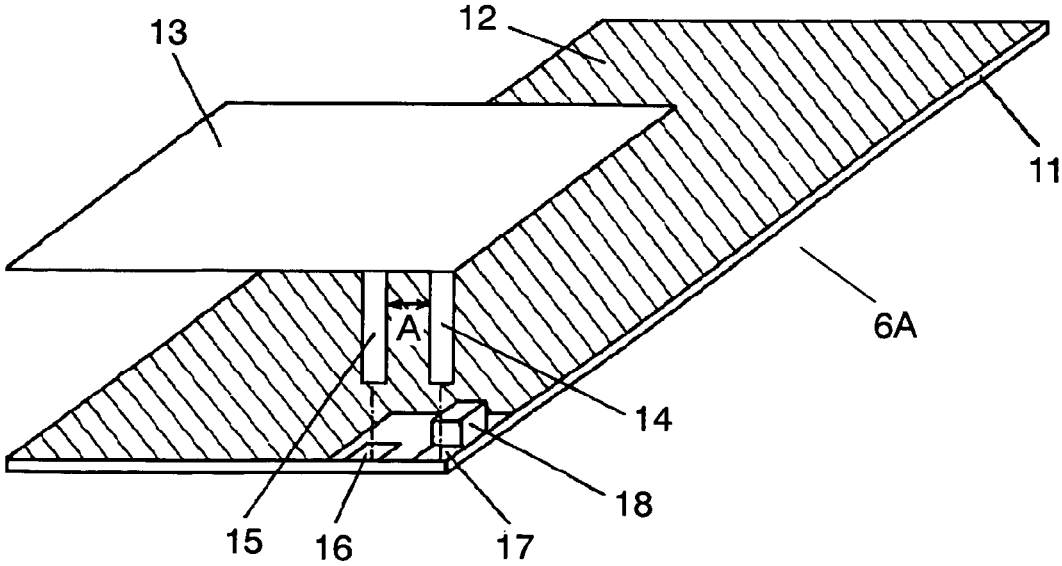
FIG. 2 shows an exploded perspective view of a planar inverted-F antenna according to the exemplary embodiment of the present invention.

FIG. 2 shows an exploded perspective view of antenna 6A according to the exemplary embodiment of the present invention. Ground plate 12 is provided on circuit board 11, and planar radiator 13 is disposed over circuit board 11 facing ground plate 12. Short line 14 and feed line 15 are connected to radiator 13. Feed terminal 16 is formed on circuit board 11 to connect feed line 15 with a circuit (not shown) on circuit board 11. Terminal 17 formed on circuit board 11 is connected to short line 14. As terminals 16 and 17 are provided on circuit board 11, radiator 13 can be set easily.

Chip coil 18 as an inductance element is mounted on circuit board 11 to connect terminal 17 with ground plate 12 electrically. That is, chip coil 18 is connected between short line 14 and ground plate 12 electrically through terminal 17. Antenna 6A has radiator 13, ground plate 12, feed line 15 and short line 14. Radiator 13, ground plate 12, feed line 15 and short line 14 are made of for instance a conductive material such as oxygen free high conductivity copper or a resilient phosphor bronze respectively. In addition, a plastic holder or the like can be provided between radiator 13 and ground plate 12.

The impedance of antenna 6A is the sum of the reactance of feed line 15, the reactance of short line 14, and the impedance of radiator 13 connected in parallel. Distance A between feed line 15 and short line 14 has to be adjusted for the impedance matching. However, achieving the impedance matching only by adjusting distance A between feed line 15 and short line 14 tends to be difficult along with the downsizing of antenna 6A. This becomes a significant hamper in designing of a mobile communication device using antenna 6A. In the present exemplary embodiment, chip coil 18 is mounted on circuit board 11 where terminal 17 and ground plate 12 are connected. The configuration enables the impedance to match easily while downsizing of the antenna is maintained.

Figure 3:
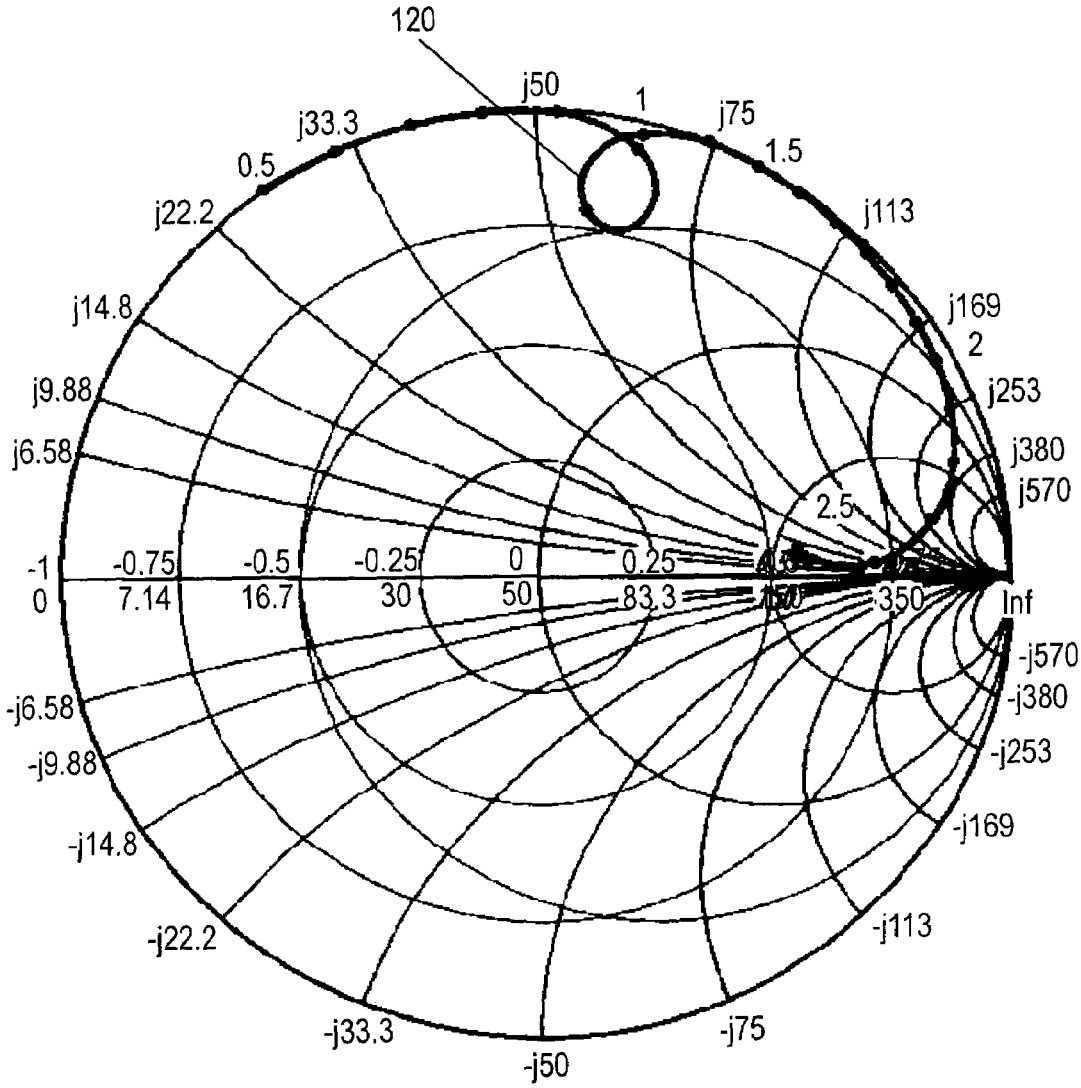
FIG. 3 PRIOR ART
FIG. 3 shows an impedance characteristic of a conventional planar inverted-F antenna.
Figure 8:
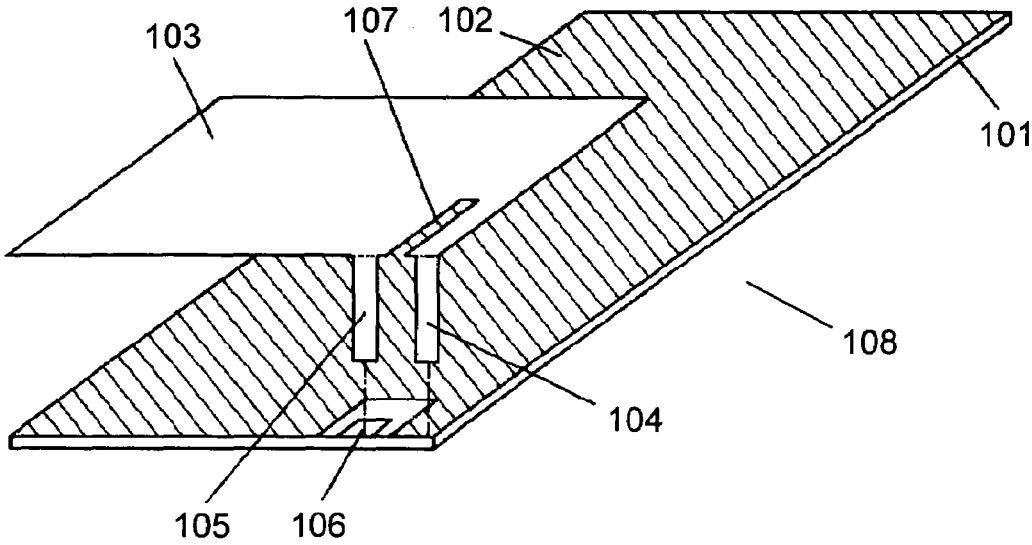
PRIOR ART FIG. 8 PRIOR ART
FIG. 8 shows an exploded perspective view of the conventional planar inverted-F antenna.

FIG. 3 shows an impedance characteristic of antenna 108 shown in FIG. 8 having no chip coil, that is a Smith-chart with distance A between feed line 15 and short line 14 of 1 mm. The chart implies that the impedance matching is achieved better when the characteristic curve locates as near to the center (50 Ω impedance) as possible. In reality, however, characteristic curve 120 locates far from the center, causing a poor impedance matching to the 50 Ω impedance.

The results are obtained because the distance between feed line 105 and short line 104 is too narrow and therefore the distance must be widened. However, widening the distance or adding slits for the required characteristic would eventually cause a difficulty in downsizing or changing of geometry of the antenna.

Figure 4:
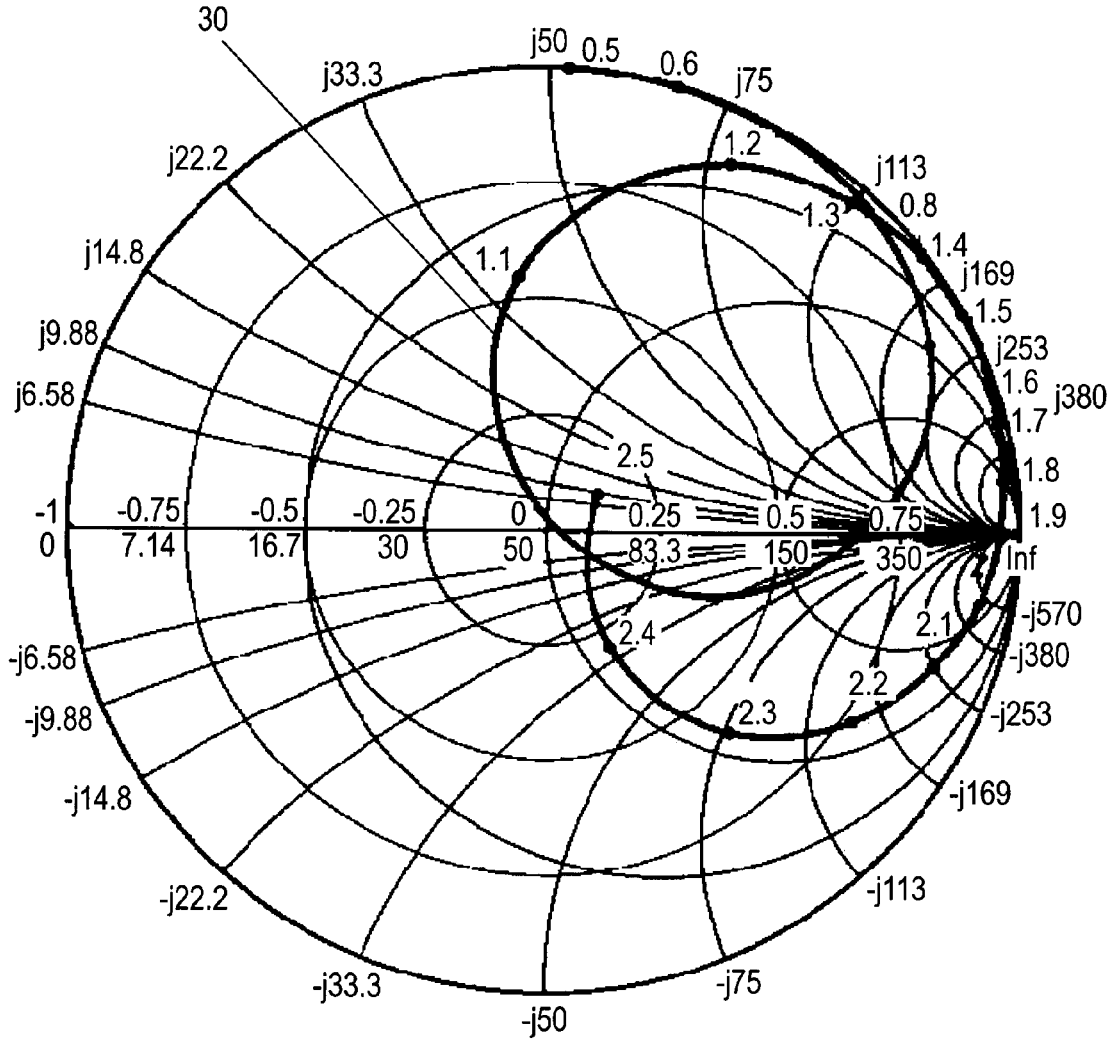
FIG. 4 shows an impedance characteristic of the planar inverted-F antenna according to the exemplary embodiment of the present invention.

FIG. 4 shows an impedance characteristic of antenna 6A according to the exemplary embodiment. FIG. 4 is a Smith chart for antenna 6A with distance A between feed line 15 and short line 14 of 1 mm, and with chip coil 18 of 6.8 nH disposed between terminal 17 and ground plate 12. The impedance at a required frequency band locates approximately in the center of the chart as shown in the characteristic curve 30 of FIG. 4. This shows that the impedance matching can be achieved by only adding the most suitable chip coil 18 without any change in antenna configuration.

As described above, varying the element value of chip coil 18 has equivalent effects of changing the distance between feed line 15 and short line 14, enabling antenna 6A to achieve a proper impedance matching.

Figure 5:
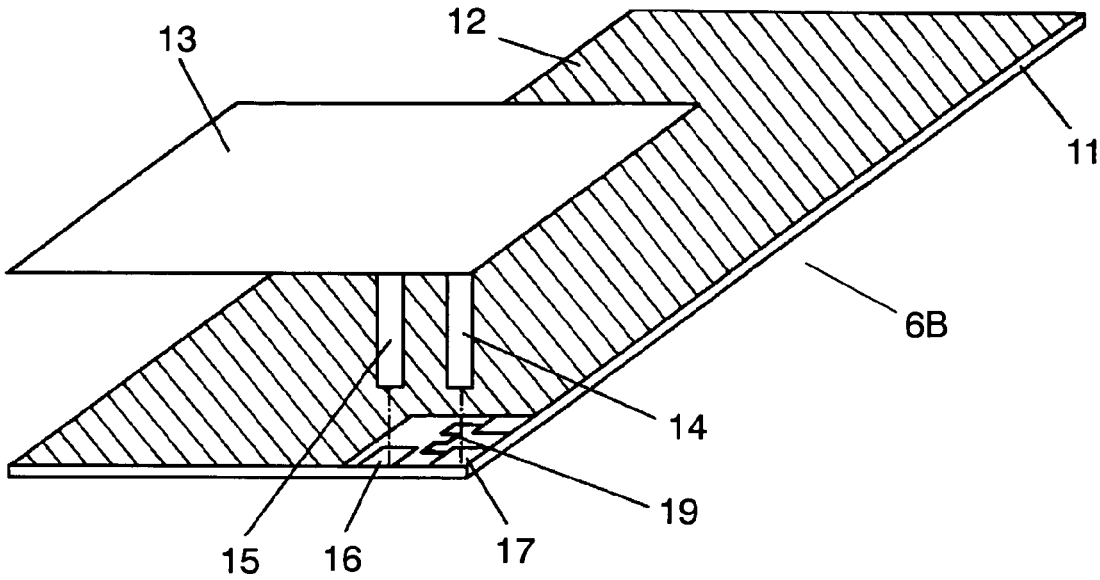
FIG. 5 shows an exploded perspective view of another planar inverted-F antenna according to the exemplary embodiment of the present invention.

Next, the configuration of another planar inverted-F antenna according to the exemplary embodiment is described with reference to FIG. 5. FIG. 5 shows an exploded perspective view of another planar inverted-F antenna.

The difference between antenna 6B shown in FIG. 5 and antenna 6A shown in FIG. 2 is that an inductance element is formed in circuit pattern 19 provided on circuit board 11. The other configurations are identical to antenna 6A.

The configuration can form the inductance using circuit pattern 19 only, enabling antenna 6B with a cheaper production cost.

Instead of circuit pattern 19, adopting other configuration such as bonding a winding of copper wire or copper foil can provide similar effects.

Figure 6:
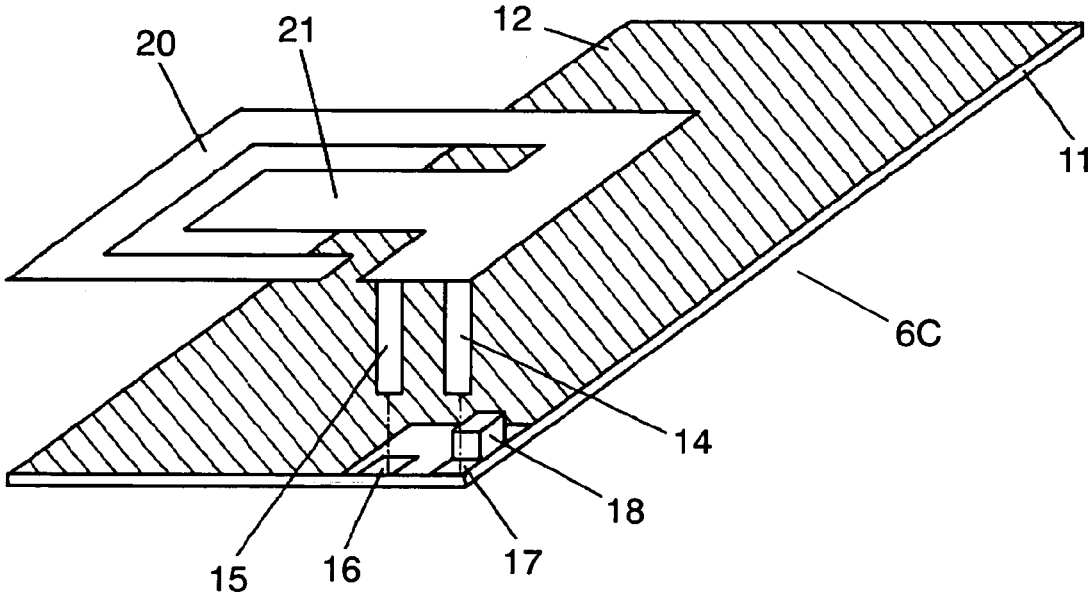
FIG. 6 shows an exploded perspective view of still another planar inverted-F antenna used according to the exemplary embodiment of the present invention.
Figure 7A:
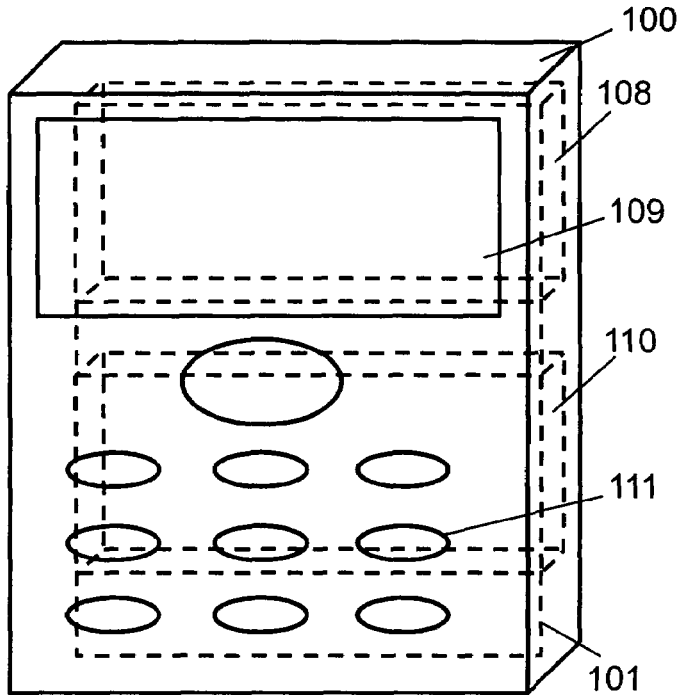
FIG. 7A shows a perspective view of a conventional mobile communication device.
Figure 7B:
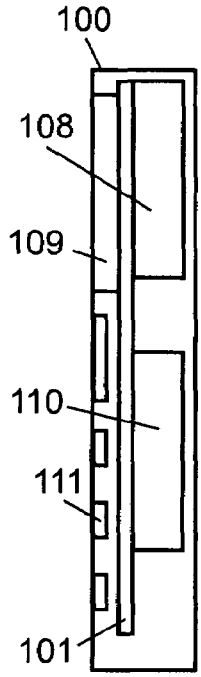
PRIOR ART FIG.7B
FIG. 7B shows a perspective side view of the conventional mobile communication device.

Next, the configuration of still another planar inverted-F antenna according to the exemplary embodiment is described with reference to FIG. 6. FIG. 6 shows an exploded perspective view of still another planar inverted-F antenna.

While antenna 6A has a single radiator 13 as shown in FIG. 2, antenna 6C shown in FIG. 6 has first radiator 20 and second radiator 21. The other configurations are identical to antenna 6A.

The configuration can provide antenna 6C with a capability to respond to a plurality of frequencies because first radiator 20 and second radiator 21 respond respective frequencies. The mobile communication device using such antenna 6C can respond to a plurality of frequencies.

INDUSTRIAL APPLICABILITY

The disclosed is a downsized antenna capable of adjusting the impedance without changing the antenna geometry. Such an antenna is useful for mobile communication devices.

The invention claimed is:

1. An antenna comprising:

a circuit board;

a ground plate located on the circuit board;

a planar first radiator facing the ground plate;

a short line connected to the first radiator;

a feed line connected to the first radiator; and an inductance element comprising a circuit pattern on the circuit board, and connected electrically between the ground plate and the short line.

2. The antenna according to claim 1, wherein the inductance element is a chip coil.

3. The antenna of claim 1, further comprising a second radiator similar to the first radiator.

4. A mobile communication device comprising:

a housing;

an antenna of claim 1, the circuit board located in the housing;

an input unit connected to the circuit board to receive information; and an output unit connected to the circuit board to output information input into the circuit.

5. The mobile communication device according to claim 4, further comprising:

a terminal on the circuit board to connect the short line with the inductance element; and a feed terminal on the circuit board to connect the circuit with the feed line.

6. The mobile communication device according to claim 4, wherein the ground plate and the planar first radiator of the antenna have common edges on three sides.

7. The antenna according to claim 1, wherein the ground plate and the planar first radiator have common edges on three sides.

* * * * *